US006323824B1

(12) United States Patent
Heinrichs et al.

(10) Patent No.: US 6,323,824 B1
(45) **Date of Patent: *Nov. 27, 2001**

(54) DIELECTRIC RESONATOR ANTENNA

(75) Inventors: Frank Heinrichs; Tilman Schlenker, both of Aachen (DE)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/369,540

(22) Filed: Aug. 6, 1999

(30) Foreign Application Priority Data

Aug. 17, 1998 (DE) ..... 198 37 266

(51) Int. Cl.[7] ..... H01Q 1/48
(52) U.S. Cl. ..... 343/846; 343/785; 343/789; 343/873
(58) Field of Search ..... 343/846, 873, 343/785, 789, 700 MS, 702

(56) References Cited

U.S. PATENT DOCUMENTS

| | | | | |
|---|---|---|---|---|
| 5,453,754 | * | 9/1995 | Fray | 343/789 |
| 5,581,262 | * | 12/1996 | Kawahata et al. | 343/873 |
| 5,923,305 | * | 7/1999 | Sadler et al. | 343/702 |
| 5,940,036 | * | 8/1999 | Oliver et al. | 343/700 MS |
| 5,952,972 | * | 9/1999 | Ittipiboon et al. | 343/873 |
| 6,052,087 | * | 4/2000 | Ishikawa et al. | 343/700 MS |

FOREIGN PATENT DOCUMENTS

| | | | |
|---|---|---|---|
| 3509014 | 9/1986 | (DE) | G01G/1/14 |
| 0790663A1 | 8/1997 | (EP) | H01Q/1/24 |
| 0767510A1 | 4/1997 | (EP) | H01Q/9/04 |

OTHER PUBLICATIONS

By Rajesh K. Mongia & Prakash Barthis, "Dielectric Resonator Antennas—A Review and General Design Relations for Resonant Frequency and Bandwith", Intern. Journal of Microwave and Millimeter–Wave Computer–Aided Engineering, vol. 4, No. 3, 1994, pp. N230–247.

IIEE Antennas and Propagation Sec. Int. Sep. 1997, vol. 4. pp. 2202–2205, by R. K. Mongia "Reduced Size Metallized Dielectric Resonator Antennas", Comdev Ltd.

By K.W. Leug, K.Y. Chow. K.M. Luck & E.K.N. Yung, Excitation of Dielectric Resonator Antenna Using a Soldered–Through Probe, Electronics Letters, Feb. 27, 1997, vol. 33, No. 5 pp.349–350.

By R. K. Mongia, A. Ittibipoon & M. Cuhaci, Low Profile Dielectric Resonator Antennas Using a Very High Permittivity Material, Electronics Letters, Aug. 18, 1994, vol. 30 No. 17. pp. 1362–1363.

* cited by examiner

*Primary Examiner*—Don Wong
*Assistant Examiner*—Thuy Vinh Tran
(74) *Attorney, Agent, or Firm*—Dicran Halajian

(57) ABSTRACT

A dielectric resonator antenna has a dielectric layer and a conducting layer formed on a main surface of the dielectric layer. An electrical contact is formed on the main surface for connecting the dielectric layer to a transmission line for transferring a signal between the dielectric layer and the transmission line. The electrical contact is insulated from the conducting layer. A conducting strip is connected to the electrical contact and is on a side surface of the dielectric layer. The side surface is not on the same plane of the main surface. Rather, the side surface is perpendicular to the main surface of the dielectric layer.

14 Claims, 2 Drawing Sheets

DIELECTRIC RESONATOR ANTENNA

FIELD OF THE INVENTION

The invention relates to a dielectric resonator antenna (DRA) having an electrically conducting layer in a plane of symmetry.

Furthermore, the invention relates to a transmitter and a receiver having a dielectric resonator antenna with an electrically conducting layer in a plane of symmetry and also to a mobile radiotelephone with such an antenna.

BACKGROUND OF THE INVENTION

Dielectric resonator antennas (DRA) are known as miniaturized antennas of ceramics or another dielectric medium for microwave frequencies. In a dielectric resonator whose dielectric medium $\in_r >> 1$ is surrounded by air, this dielectric medium has a discrete spectrum of self-frequencies and self-modes. Contrary to a resonator, which has a very high quality when radiation losses are avoided, the radiation of power is in the forefront in the resonator antenna. Since no conducting structures are used as a radiating element, the skin effect can have no detrimental consequences. Therefore, such antennas have low-ohmic losses at high frequencies. When materials having a high dielectric constant are used, furthermore a compact, miniaturized structure may be achieved. FIG. 1 shows such a DR antenna 1 in the basic form regarded as an example. In addition to the form of a parallelepiped, also other forms are possible, such as for example, cylindrical or spherical geometries. Dielectric resonator antennas are resonant elements which operate only in a narrow band around one of the their resonant frequencies. The problem of the miniaturization of an antenna is equivalent to lowering the operating frequency with given antenna dimensions. As a result, the lowest resonance ($TE^z_{111}$-mode) is used. This mode has a plane, which is called plane of symmetry 2, in which the tangential component of the electric field disappears. When the antenna is halved in the plane of symmetry 2 and an electrically conducting surface 3 is deposited (for example, a metal plate), the resonant frequency continues to be equal to the resonant frequency of an antenna having the original dimensions. This is represented in FIG. 2. A further miniaturization with this antenna can be achieved by means of a dielectric medium having a high dielectric constant $\in_r$. For this purpose, preferably a material having minor dielectric losses is chosen.

Such a dielectric resonator antenna is described in the article "Dielectric Resonator Antennas—A review and general design relations for resonant frequency and bandwidth", Rajesh K. Mongia and Prakash Barthia, Intern. Journal of Microwave and Millimeter-Wave Computer-aided Engineering, vol. 4, no. 3, 1994, pp. 230–247. The article gives an overview of the modes and radiation characteristic for various shapes, such as cylindrical, spherical and rectangular DRAs. For different shapes the possible modes and planes of symmetry are shown (see FIGS. 4, 5, 6 and page 240, left column, lines 1–21). Particularly a parallelepiped-shaped dielectric resonator antenna is described in the FIG. 9 and the associated description. By means of a metal surface in the x-z plane with y=0, or in the y-z plane with x=0, the original structure may be halved without modifying the field distribution or other resonance characteristics for the $TE^z_{111}$-mode (page 244, right column, lines 1–7). The DRA is excited via a microwave transmission line in that it is inserted into the stray field in the neighborhood of a microwave line (for example, a microstrip line or the end of a coaxial line).

With this type of coupling of the power, the impedance matching of the dielectric resonator antenna with the transmission line, necessary for a good efficiency, is hard, because the matching strongly depends on the position of the antenna relative to the transmission line. The deviation of the relative position of the transmission line, however, strongly varies especially in the case of automatic production.

SUMMARY OF THE INVENTION

It is an object of the invention to provide a better coupling of the dielectric resonator antenna to a transmission line.

The object is achieved in that in the plane of symmetry at least one electrical contact, insulated from the electrically conducting layer, is provided and in that the electric layer and the electrical contact are used for connecting the dielectric resonator antenna to at least one transmission line for a signal to be transmitted or received. In this manner, two electrical contacts evolve that are fixedly connected to the dielectric resonator antenna, which contacts may be connected to the DRA for coupling the power. An antenna according to the invention may be mounted with other components onto a printed circuit board (PCB) in the known SMD technique (soldering onto the surface of the printed circuit board). This DRA allowing of SME may be fixedly soldered with the transmission lines onto the printed circuit board, so that a distinctly better coupling is achieved than when a transmission line is inserted into the leakage field. The impedance matching depends considerably less on the exact positioning of the antenna on the printed circuit board, than when inserted into the leakage field, for which case the matching strongly depends on the distance from the antenna to the transmission line.

In an advantageous embodiment, a metallic layer is provided for forming the electrically conducting layer in the plane of symmetry and for forming the electrical contact. Based on their good manufacturing properties and electrical conductivity, metallic layers are highly suitable for realizing the connection to a transmission line.

In a further embodiment, a metallic layer is provided on a side of the DRA adjacent the plane of symmetry for connection to the electrical contact in the plane of symmetry. In this manner, the extension by the metallic layer achieves a very good excitation of the dielectric resonator antenna. For example, with a parallelepiped-shaped antenna and the plane of symmetry as a base, the electrical contact may be arranged on an adjacent head-end. The metallic layer is then continued over the edge to the base, so that a soldering point develops in the plane of symmetry, which point may be used for the surface mounting. This soldering point is naturally insulated from the electrically conducting layer, which is preferably done by skipping a small area when the plane of symmetry is metallized. Preferably, a silver paste is used for forming the metallic layer by burning into the material of the DRA.

In a preferred further embodiment, a ceramic of (Ba,Nd, Gd)$TiO_3$ is provided as a material for the dielectric resonator antenna. This ceramic material has all the important properties for the dielectric resonator antenna such as a high dielectric constant, a low dielectric losses and a low dielectric temperature coefficient.

Further advantageous embodiments are contained in the further claims.

Besides, the object of the invention is further achieved by a transmitter and a receiver and a mobile radiotelephone in which in the plane of symmetry of the antenna at least one electrical contact is provided insulated from the electrically conducting layer and the electrical layer and the electrical contact are provided for connecting the dielectric resonator antenna to at least one transmission line for a signal to be transmitted or received.

These and other aspects of the invention are apparent from and will be elucidated with reference to the embodiments described hereinafter.

BRIEF DESCRIPTION OF THE INVENTION

DETAILED DESCRIPTION OF THE INVENTION

Figure 1:
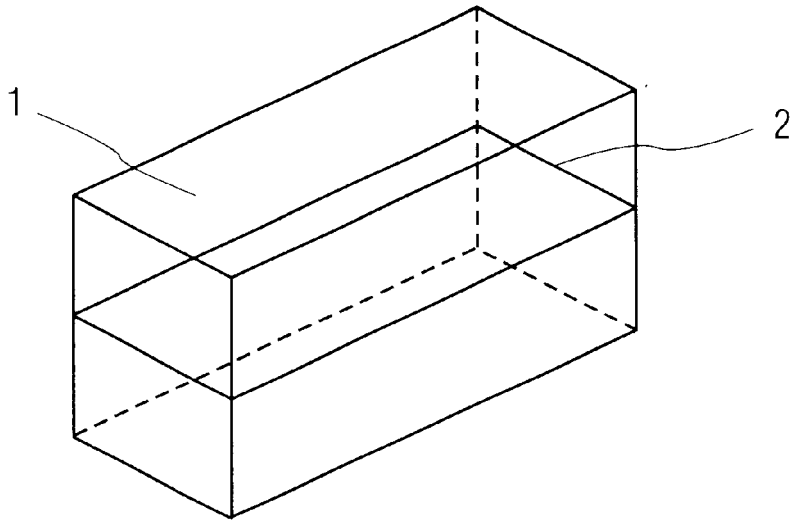
FIG. 1 shows a dielectric resonator antenna.
Figure 2:
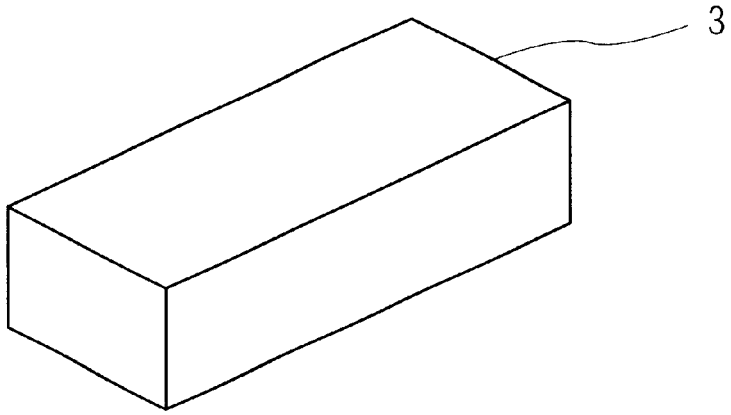
FIG. 2 shows a halved dielectric resonator antenna having an electrically conducting layer in a plane of symmetry.
Figure 3:
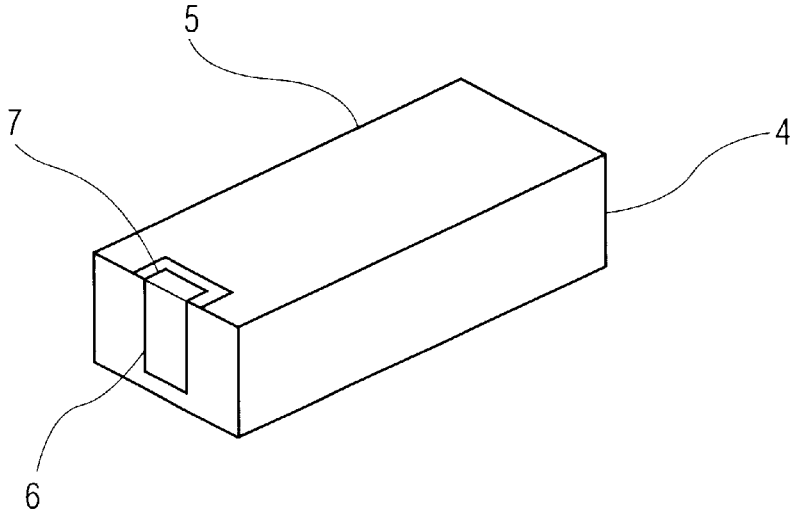
FIG. 3 shows a dielectric resonator antenna having electrical contacts in accordance with the invention for a surface mounting.

In FIG. 3 is shown a dielectric resonator antenna (DRA) 4 having a metallic layer 5 in a plane of symmetry. Furthermore, the ceramic parallelepiped of the DRA 4 has a second metallic layer 6 on one head-end. The second metallic layer 6 has a soldering point 7 that is located in the plane of symmetry, electrically insulated from the metallic layer 5. The soldering point 7 forms the additional electrical contact in the plane of symmetry. For this purpose, the plane of symmetry, into which the tangential component of the electric field of the desired self-mode (lowest resonance in $TE^{z}_{111}$-mode) disappears, is covered by a metallic layer fixedly attached to the dielectric medium. This is preferably done with a silver paste burned into the ceramic. The second metallic layer 6 on the head end is deposited in the same manner. These metallic layers 5, 6, 7 enable a Surface Mount Device (SMD), thus the planar soldering of electric components on a Printed Circuit Board (PCB), by means of a solder bath or a reflow process.

Figure 4:
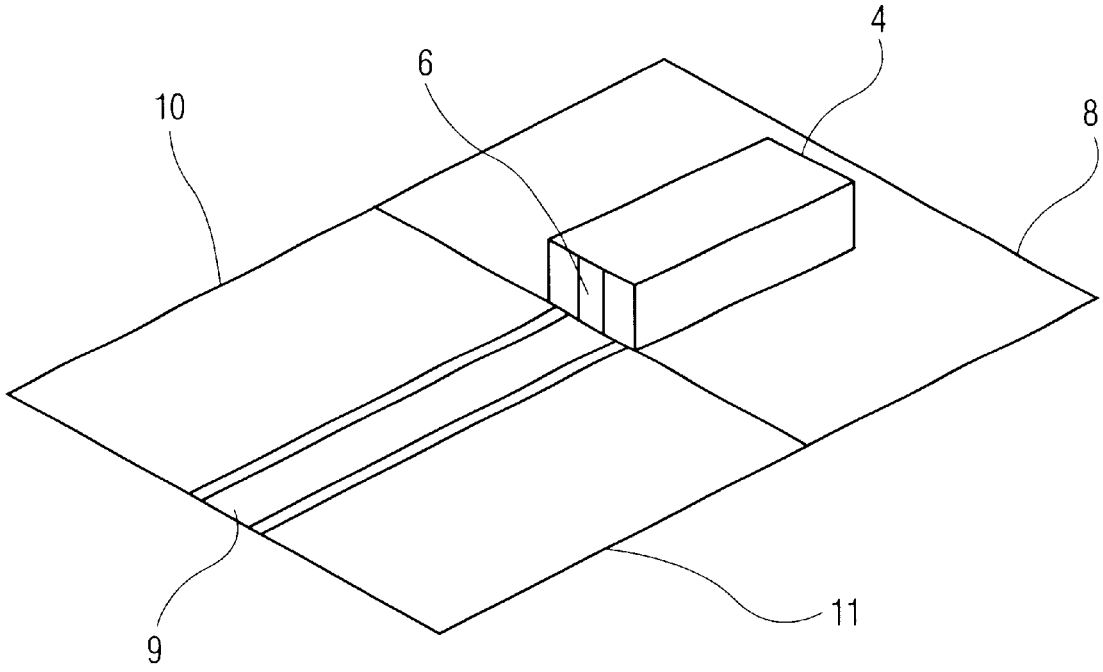
FIG. 4 shows a PCB-mounted antenna in accordance with the invention.

In FIG. 4 is represented a DRA 4 with metallic layers 5 and 6, which DRA 4 was soldered onto a printed circuit board 8 in the surface mount technique with a coplanar strip line 9, 10, 11. The metallic layer 6 on the head end is then electrically connected to a transmission line 9 at the soldering point 7, which can no longer be seen after the mounting. The metallic layer of the plane of symmetry 5 is connected at two soldering points to the grounded surfaces 10 and 11 of the coplanar line 9, 10, 11. An antenna 4 mounted in this manner provides a good coupling to the transmission line 9, 10, 11 which has a very good impedance match (return-loss of −35 dB) which provides a very good efficiency. The good values for the impedance matching are robust to variations in the exact form and size of the metallic layers and the position of the antenna on the printed circuit board 8.

This achieves the following advantages. The antenna is fixedly soldered to the conductor lines 9, 10, 11 of the supply printed circuit board 8. The soldering is effected flat on the printed circuit board surface, thus in the SMD technique known as a manufacturing technique in the electronics industry. This provides that the mounting of the antenna 4 may be combined with other components. Furthermore, a DRA 4 mounted such has a very good impedance match with the transmission line 9, 10, 11, which is robust to inaccuracies in the positioning of the DRA 4. The DRA 4 described may preferably be realized by means of a parallelepiped having dimensions 15×5×6 $mm^3$ of a $(Ba,Nd,Gd)TiO_3$ ceramic. This material is suitable for high frequencies, has a dielectric constant of $e_r$=85, low dielectric losses of $\tan\delta=4\times10^{-4}$ and a low dielectric temperature coefficient of $\tau_{\in}$=−30 ppm/° C. (NPO characteristics). The metallic layers 5 and 6 are established by means of a silver paste, which is burned in at a temperature of 700 ° C., so that a closed, high-performance metallic layer is developed. The microstrip line 9, 10, 11 can be deposited on a standard printed circuit board substrate 8 having a wave resistance of 50 Ohms. The operating frequency of such a DRA 4 lies at 2.1 GHz, so that it is especially suitable for applications in the mobile radiotelephone domain.

What is claimed is:

1. A dielectric resonator antenna comprising:

a dielectric layer which is configured to resonate in response to a signal;

a a conducting layer formed on a main surface of said dielectric layer; and an electrical contact of a conducting material formed on said main surface for connecting said dielectric layer to a transmission line for transferring said signal between said dielectric layer and said transmission line, wherein said electrical contact is insulated from said conducting layer.

2. The dielectric resonator antenna of claim 1, further comprising a conducting strip which is connected to said electrical contact, said conducting strip being formed on a side surface of said dielectric layer.

3. The dielectric resonator antenna of claim 2, wherein said side surface is perpendicular to said main surface.

4. The dielectric resonator antenna of claim 2, wherein said side surface is not on a plane of said main surface.

5. The dielectric resonator antenna of claim 1, wherein said conducting layer and said electrical contact are a metal.

6. The dielectric resonator antenna of claim 1, wherein said conducting layer and said electrical contact are formed from a silver paste.

7. The dielectric resonator antenna of claim 1, wherein said conducting layer and said electrical contact are formed from burning a silver paste on said main surface of said dielectric layer.

8. The dielectric resonator antenna of claim 1, wherein said dielectric layer is a ceramic of $(Ba,Nd,Gd)TiO_3$.

9. The dielectric resonator antenna of claim 1, wherein said transmission line is a strip line.

10. The dielectric resonator antenna of claim 1, wherein said dielectric layer has a shape of a parallelepiped having two head ends, two side faces, and upper face and said main surface which is opposite said upper face.

11. The dielectric resonator antenna of claim 10, further comprising a conducting strip which is connected to said electrical contact, said conducting strip being formed on one of said two head ends of said dielectric layer.

12. A transmitter having a dielectric resonator antenna, said dielectric resonator antenna comprising:

a dielectric layer which is configured to resonate in response to a signal;

a conducting layer formed on a main surface of said dielectric layer; and an electrical contact of a conducting material formed on said main surface for connecting said dielectric layer to a transmission line for transferring a signal between said dielectric layer and said transmission line, wherein said electrical contact is insulated from said conducting layer.

13. A receiver having a dielectric resonator antenna, said dielectric resonator antenna comprising:

a dielectric layer which is configured to resonate in response to a signal;

a conducting layer formed on a main surface of said dielectric layer; and an electrical contact of a conducting material formed on said main surface for connecting said dielectric layer to a transmission line for transferring a signal between said dielectric layer and said transmission line, wherein said electrical contact is insulated from said conducting layer.

14. A mobile radiotelephone having a dielectric resonator antenna, said dielectric resonator antenna comprising:

a dielectric layer which is configured to resonate in response to a signal;

a conducting layer formed on a main surface of said dielectric layer; and an electrical contact of a conducting material formed on said main surface for connecting said dielectric layer to a transmission line for transferring a signal between said dielectric layer and said transmission line, wherein said electrical contact is insulated from said conducting layer.

* * * * *